US006584924B2

(12) United States Patent
Jordan

(10) Patent No.: US 6,584,924 B2
(45) Date of Patent: Jul. 1, 2003

(54) APPARATUS FOR CONTROLLING PRESSURE RECOVERY

(75) Inventor: Stephen A. Jordan, Narragansett, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 76 days.

(21) Appl. No.: 09/781,231

(22) Filed: Feb. 13, 2001

(65) Prior Publication Data

US 2002/0108552 A1 Aug. 15, 2002

(51) Int. Cl.[7] ..... F41F 3/08

(52) U.S. Cl. ..... 114/238; 114/21.2; 114/316; 114/317; 114/318; 114/319; 114/320; 114/313; 102/399; 244/199; 244/204; 89/1.809; 89/1.81

(58) Field of Search ..... 114/21.2, 238, 114/316, 317, 318, 319, 320, 313; 102/399; 244/199, 204; 89/1.809, 1.81

(56) References Cited

U.S. PATENT DOCUMENTS

| | | | | | |
|---|---|---|---|---|---|
| 2,342,996 | A | * | 2/1944 | Barker et al. | 114/238 |
| 3,857,321 | A | * | 12/1974 | Cohen | 114/238 |
| 4,383,552 | A | * | 5/1983 | Baker | 137/504 |
| 4,523,538 | A | * | 6/1985 | Hollmann et al. | 114/238 |
| 4,706,910 | A | * | 11/1987 | Walsh et al. | 114/67 R |
| 4,786,020 | A | * | 11/1988 | Franke et al. | 244/130 |
| 4,854,260 | A | * | 8/1989 | Woidich et al. | 114/316 |
| 5,003,909 | A | * | 4/1991 | Moody | 114/238 |
| 5,009,182 | A | * | 4/1991 | Moody | 114/238 |
| 5,040,560 | A | * | 8/1991 | Glezer et al. | 137/13 |
| 5,044,253 | A | * | 9/1991 | Moody | 114/238 |
| 5,050,523 | A | * | 9/1991 | Schwemin et al. | 114/259 |
| 5,054,966 | A | * | 10/1991 | Filippelli | 138/119 |
| 5,127,945 | A | * | 7/1992 | Miller | 106/14.44 |
| 5,165,360 | A | * | 11/1992 | Moody | 114/316 |
| 5,284,106 | A | * | 2/1994 | Meng | 114/238 |
| 5,322,002 | A | * | 6/1994 | Miskelly et al. | 89/1.7 |
| 5,410,978 | A | * | 5/1995 | Waclawik et al. | 114/238 |
| 5,447,115 | A | * | 9/1995 | Moody | 114/312 |
| 5,568,782 | A | * | 10/1996 | Moody | 114/238 |
| 5,597,985 | A | * | 1/1997 | Dear et al. | 138/121 |
| 5,755,408 | A | * | 5/1998 | Schmidt et al. | 244/130 |
| 5,834,674 | A | * | 11/1998 | Rodriguez et al. | 114/20.1 |
| 5,901,928 | A | * | 5/1999 | Raskob, Jr. | 244/130 |
| 5,961,080 | A | * | 10/1999 | Sinha | 244/130 |
| 6,078,674 | A | * | 6/2000 | Cattafesta et al. | 244/1 N |
| 6,092,766 | A | * | 7/2000 | LaRoche et al. | 244/198 |
| 6,105,904 | A | * | 8/2000 | Lisy et al. | 244/130 |
| 6,332,593 | B1 | * | 12/2001 | Kamiadakis et al. | 244/130 |
| 6,345,791 | B1 | * | 2/2002 | McClure | 244/130 |
| 6,371,414 | B1 | * | 4/2002 | Truax et al. | |
| 6,418,870 | B1 | * | 7/2002 | Lanowy et al. | 114/238 |

FOREIGN PATENT DOCUMENTS

| | | | |
|---|---|---|---|
| DE | 3737090 | * | 5/1989 |

* cited by examiner

*Primary Examiner*—Michael J. Carone
*Assistant Examiner*—John Richardson
(74) *Attorney, Agent, or Firm*—James M. Kasischke; Michael J. McGowan; Michael F. Oglo

(57) ABSTRACT

An apparatus for controlling fluid pressure recovery includes an elongated housing having an opening at a first end thereof, an opening at a second end thereof, an inner peripheral surface, and a fluid flow passageway therethrough. The apparatus further includes a plurality of choke members fixed to the inner peripheral surface of the housing, each of the plurality of choke members being spaced from an adjacent choke member and projecting a predetermined distance into the fluid flow passageway of the longitudinal housing. The plurality of choke members sequentially produce a reduced turbulent free shear fluid layer from the first end to the second end of the elongated housing.

22 Claims, 3 Drawing Sheets

APPARATUS FOR CONTROLLING PRESSURE RECOVERY

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

This invention generally relates to an apparatus for controlling pressure recovery. More particularly, the invention relates to an apparatus for controlling pressure recovery in a submarine cylindrical shutter way/guide-can recess.

(2) Description of the Prior Art

The current art and known construction of a submarine torpedo launchway causes a substantial recovery of dynamic pressure in a cylindrical shutterway/guide-can recess (SGR).

Referring to the conventional art of FIG. 1, the known SGR is illustrated therein. Specifically, the portion of the submarine showing the launchway location of a torpedo T prior to launch is depicted in general by reference number 10. The launchway 10 includes a shutterway 12, and a guide-can recess 14 in longitudinal alignment with the shutterway 12. An entering flow of sea water 16 passes into a first end 12*a* of the shutterway 12 and enters the guide-can 14 at a passage opening 18 at a second end 12*b* of the shutterway 12 and a first end 14*a* of the guide-can 14. The guide-can 14 and shutterway 12 are those portion of the launchway 10 through which the torpedo T passes upon firing the torpedo from the submarine.

The second end 14*b* of the guide-can 14 terminates in an opening, thereby defining an open area 20 between the guide-can 14 and a launch tube 22 of the submarine. The entering flow 16 becomes either stagnation flow 24 or redirected flow 26 as explained in the following.

Just prior to launch, when a muzzle door (not shown) of the torpedo launch tube 22 has opened, the pressure head of water that has built up at the entrance to the launch tube 22, or otherwise termed "recovered pressure", induces an adverse pressure gradient along a length of the torpedo T while the torpedo is in the tube 22. An adverse pressure gradient means that the pressure is higher at the nose of the torpedo compared to the pressure at its tail end. This condition energizes a breechward movement of the torpedo T that could result in structural damage to the weapon if this condition becomes excessive. Furthermore, fluid flow from the torpedo tube 22 to the turbine pump is reversed, thereby causing an undue stress on the turbine pump of the torpedo at start-up. Over time, this undue stress may structurally fatigue a turbine pump clutch of the torpedo.

An inspection of the submarine launchway reveals the probable cause for the adverse pressure gradient along the torpedo while in the tube 22. Specifically, the large separation between the second end 14*b* of the guide-can 14 and the torpedo tube 22 permits flow through the SGR and into a free-flood region 28 of the submarine. This separation is necessary to allow opening of the torpedo tube muzzle door just prior to launch of the torpedo. Note that the free flood region 28 of the submarine is formed to be outwardly concentrical with the shutterway 12/guide-can 14 portion, and receives the redirected flow 26 from the guide-can 14. It is also revealed that the free-flood region 28 is not isolated from the flow dynamics external to the hull of the shutterway 12 and guide-can 14. In particular, the sides and rear of doors to the shutterway 12 do not seat tightly against the external hull in their closed position. Large gaps which frame the shutter doors permit low-velocity flow, indicted at 28*a,* through the free-flood region that eventually leads to the flow dynamics external to the submarine hull. The high-momentum/low-volume flow through the SGR is supported by a low-momentum/high-volume flow through the free-flood region. The high-momentum flow through the SGR stagnates locally at the torpedo tube muzzle door as shown by 24, thereby recovering the full dynamic pressure of the flow through the SGR.

The ensuing event of the above flow path centers on flow stagnation 24 at the torpedo nose just prior to launch. Complete conversion of the dynamic pressure to static pressure gives a much higher static pressure at the torpedo nose compared to the pressure at its tail. A simple, but synonymous example, is a jet flow impinging on a flat plate where the recovered pressure is directly attributed to a quick termination of stream wise flow momentum due to the presence of the solid wall at the entrance to the torpedo tube 22. At the wall, the flow stagnates (24) and recovers its entire dynamic head. In this example, the flow redirects at 26 laterally along solid end walls 30 of the launch tube 22. Translated into submarine geometry, the flow redirects to the free-flood region 28.

Possible corrections for reducing the stagnation pressure 24 at the muzzle door/end walls 30 center on preventing any external flow from entering the SGR. Geometric modifications to the launchway include sealing the gaps between the shutter doors and the submarine hull, or enclosing the open zone 20 between the guide-can 14 and the torpedo tube 22. Although these changes address the symptoms of the recovered pressure problem, their functionality may not be one hundred percent assured. In particular, other access ports from the free-flood region 28 to the hull also generate external flow dynamics, but more importantly, fluid entrainment or its associated mass exchange entering the SGR can not be fully prevented due to the large characteristic length of the shutterway 12. These geometric fixes simply translate the recovered dynamic pressure zone to within the SGR itself. The stagnation pressure 24 at the torpedo nose may remain unchanged.

Thus, a problem exists in the art whereby there is a need to reduce or eliminate the stagnation flow or pressure head build up at the door of the launch tube 22. This should be done in a retrofit manner to accommodate existing submarine launch apparatus without undue expense or modification of the existing structure.

The following patents, for example, disclose various types of pressure recovery devices, but do not disclose an apparatus for controlling pressure recovery utilizing a plurality of retrofit circumferential chokes as occurs in the present invention.

U.S. Pat. No. 4,383,552 to Baker;

U.S. Pat. No. 5,020,943 to Filipelli; and

U.S. Pat. No. 5,521,340 to Thawani et al.

Specifically, the patent to Baker discloses an adjustable choke for automatically regulating high velocity flow through a pipe line. The choke comprises a generally cylindrical elongated body including an axially-directed inlet port at one end, means for selectively controlling flow though the regulator at the other end, and a radially-directed outlet port intermediate of the body. A pair of slidable, annular rings contained in the body adjacent the inlet port comprise an upstream ring and a downstream ring. Each of the rings are spring biased from the other. The upstream ring includes a flow passageway and a flow obstructing portion. The downstream ring includes a plurality of flow passageways, at least one of the downstream ring flow passageways being disposed out of communicable flow alignment with the upstream ring flow passageway. Upon impingement of sufficient flow against the obstructing portion of the upstream ring, the upstream ring is slid into abutment with the downstream ring for closing the one downstream ring flow passageway and for limiting fluid flow through the choke. Upon dissipation of the sufficient flow, the upstream ring is spring biased away from the downstream ring. The means for selectively controlling the flow is selectively, operatively engaged to the downstream ring whereby the downstream ring may be selectively slid into abutment with the upstream ring for closing the one downstream ring flow passageway. The means for selectively controlling also includes a selectively advanceable valve stem for closing the downstream ring flow passageways other than the one downstream ring flow passageway. It should be noted that the primary function of Baker s invention is limiting high velocity, which only indirectly limits high pressure. The proposed invention does not limit the centerline velocity, only the centerline pressure. Further, only two ring devices of complex geometry obstruct the flow in Baker s invention, rather than a series of chokes as in the proposed invention. Flow control (in Baker s invention) is obtained through structural obstruction, rather than turbulence ingestion in the main flow direction as in the proposed device. Next, the rings of Bakers's invention do not maintain geometric similarity of the main housing geometry. Each ring contains one large diameter center hole with five surrounding small diameter holes. The proposed invention preserves geometric similarity of the main external housing. Still further, the primary flow is redirected 90 degrees from inlet to outlet in Baker s invention, whereas the flow in the proposed invention is continuous. Bakers invention requires user control to make the invention effective, whereas the proposed invention has fixed chokes.

The patent to Filipelli discloses a cylindrical pipe of internal diameter d, intended for pneumatic transport of solid polymer particles. The pipe has constrictions located over its length in such a way that the distance 1 between two consecutive constrictions is between d and 10×d. Each constriction consists of a non-uniform restriction of the cross-sectional area S of the pipe. That restriction defines a new internal cross-sectional area S' of between 0.900×S and 0.995×S and has at least one unrestricted free passage defined by a circular sector of the area S with a vertex situated on the axis of the pipe and an angle at the vertex ranging from 5 to 60. It should be noted that the Filipelli invention is not for flow control. Instead, Filipelli inserts a series of smooth rings, which are very far apart, that inhibit the formation of polymer threads. The presence of these threads would disturb and restrict the efficient transport of the polymer particles by a hot carrier gas. In addition, Filipelli does not attempt to control either the velocity or the pressure of the main flow gas.

Thawani et al. disclose an apparatus for attenuating noise produced by fluid pressure pulsations in a hydraulic system in an automotive vehicle. The apparatus includes a muffler device comprising a generally elongate tubular member having a predetermined number of attenuating zones therein, each zone having a cross-sectional area of different size than the cross-sectional area of the tubular member. The attenuating zones are spaced at unequal lengths from one another to achieve maximized noise reduction benefits. Once again, the Thawani et al. invention is not for flow control. Instead, Thawani et al. insert a series of smooth rings for the primary purpose of reducing noise in the various piping systems of an automobile. The device is actually a muffler that contains a series of smooth rings much like the Filipelli invention. These rings attenuate any pressure fluctuations that are responsible for noise. Further, Thawani et al. do not attempt to reduce either the streamwise velocity or the static pressure of the main flow.

It should be understood that the present invention would in fact enhance the functionality of the above patents by providing a plurality of retrofit circumferential chokes within the guide-can portion of a torpedo launch apparatus.

SUMMARY OF THE INVENTION

Therefore it is an object of this invention to provide an apparatus for controlling pressure recovery.

Another object of this invention is to provide an apparatus for controlling pressure recovery whereby recovered pressure is reduced within a submarine launch tube.

Still another object of this invention is to provide an apparatus for controlling pressure recovery, the apparatus containing a series of equidistant circumferential chokes for generating high turbulent activity within the submarine launch tube.

A still further object of the invention is to provide an apparatus for controlling pressure recovery where the reduction of recovered pressure is directly proportional to the number of chokes of the apparatus.

Yet another object of this invention is to provide an apparatus for controlling pressure recovery within a submarine launch tube which is simple to manufacture and easy to use.

In accordance with one aspect of this invention, there is provided an apparatus for controlling fluid pressure recovery which includes an elongated housing having an opening at a first end thereof, an opening at a second end thereof, an inner peripheral surface, and a fluid flow passageway therethrough. The apparatus further includes a plurality of choke members fixed to the inner peripheral surface of the housing, each of the plurality of choke members being spaced from an adjacent choke member and projecting a predetermined distance into the fluid flow passageway of the longitudinal housing. The plurality of choke members sequentially produce a reduced turbulent free shear fluid layer from the first end to the second end of the elongated housing.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF THE PREFERRED EMBODIMENT

In general, the present invention is directed to an apparatus for controlling pressure recovery. More specifically, the purpose of the invention is to control the pressure recovered in a submarine cylindrical shutter way/guide-can recess, generally shown at 40 in FIG. 2. This control can minimize movement of a torpedo vehicle 36 while in a launch tube 42, which movement may be potentially harmful to the success of the torpedo launch.

Figure 1:
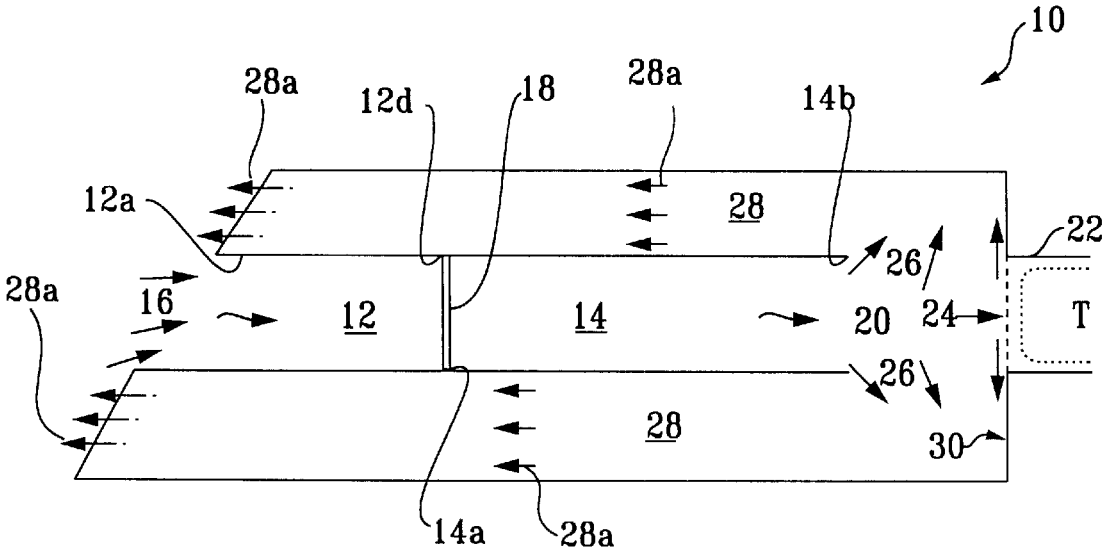
FIG. 1 PRIOR ART
FIG. 1 is a simple diagram illustrating flow paths through a known submarine shutterway/guide-can recess.
Figure 2:
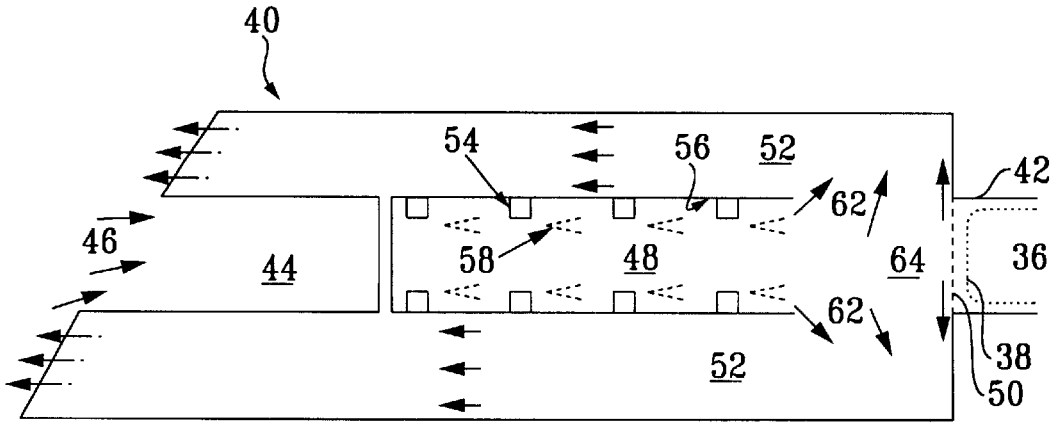
FIG. 2 is a diagram illustrating flow paths through a shutterway/guide-can recess as modified according to a preferred embodiment of the present invention.

Referring still to FIG. 2 and additionally to FIG. 3, the apparatus of the present invention deviates considerably from the above concepts discussed in connection with the known art of FIG. 1. The operation of the present invention is to decrease a stagnation pressure at a nose portion 38 of the torpedo 36 by minimizing the recovered pressures. That is, by inserting a flow control apparatus (FIG. 3) as a replacement to the known guide-can 14, a loss of recovered pressure is realized prior to the flow stagnating at the torpedo nose 38.

The overall structure includes a shutterway 44 into which an entering flow 46 will be received. The shutterway 44 is circumferentially aligned with a control apparatus 48, the control apparatus 48 replacing the known guide-can 14. Flow passing through the shutterway 44 and the control apparatus 48 is effectively dispersed prior to confrontation with a closed door 50 of a torpedo launch tube 42.

Similar to the known art, a free flood region 52 is formed circumferentially and outwardly from the shutterway 44/control apparatus 48 assembly of the launch area. It will be understood that the launch tube door 50 is selectively opened prior to launch of the torpedo 36 and the torpedo nose 38 is that portion of the torpedo closest to the launch tube door 50.

Figure 3:
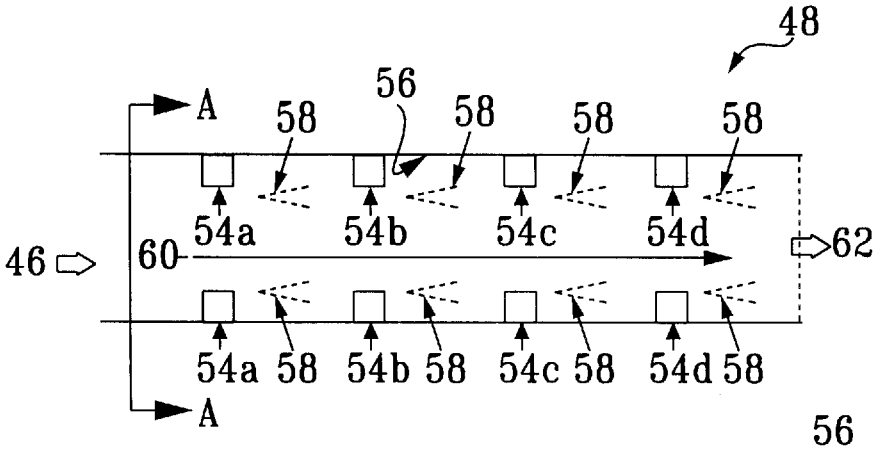
FIG. 3 is a side view of flow control apparatus according to the first preferred embodiment of the present invention.
Figure 3A:
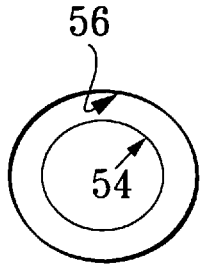
FIG. 3A is a sectional view taken along line A—A of FIG. 3.

The control apparatus 48 contains a plurality of circumferential chokes 54 placed periodically along an inner peripheral surface thereof, and along its length as illustrated in FIGS. 2 and 3. Physically, the chokes 54 induce downstream turbulent regimes locally whose intensity extract energy from a main flow 60 through the core of the apparatus 48. This extraction translates into a loss of flow momentum through the apparatus 48 and thus a concurrent reduction of recovered pressure at the door 50 of the launch tube 42. By achieving a reduction of recovered pressure in the apparatus 48, the subsequent stagnation pressure at the torpedo nose 38 is decreased.

Figure 4:
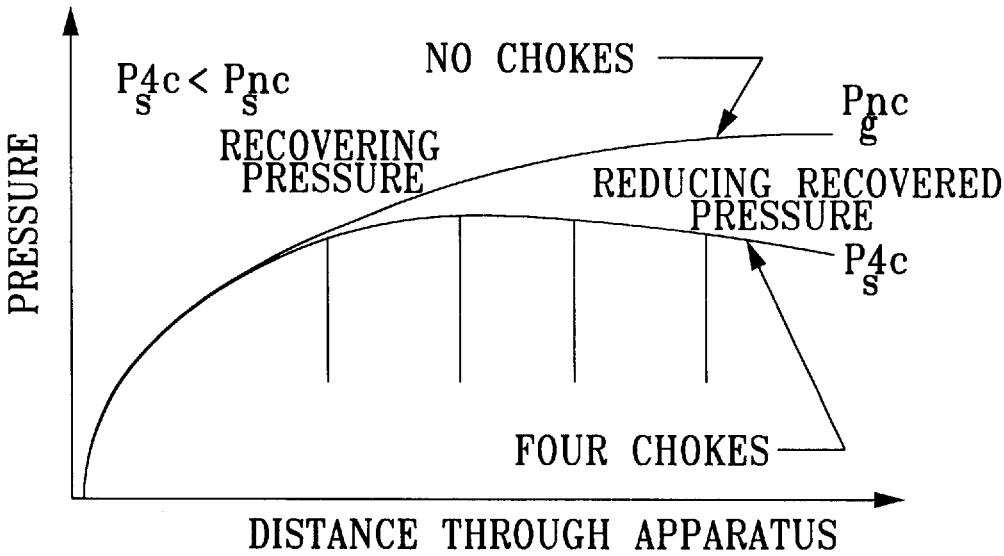
FIG. 4 is a comparison graphical representation of a reducing recovered pressure.

A sketch of the apparatus design is drawn in FIG. 3 with the flow control thereof illustrated in FIG. 4. The plurality of circumferential chokes 54 are mounted on the inner peripheral wall 56 of the apparatus. As the high-momentum flow from the shutterway 44 enters the apparatus 48 at the first of the plurality of chokes 54, the high-momentum flow impacts on the first circumferential choke 54*a*. Downstream of choke 54*a*, a turbulent free-shear layer 58 immediately develops which interacts with the adjacent main core flow 60. This viscous interaction locally extracts energy from the core flow 60 which translates ultimately to a permanent loss of the recoverable dynamic pressure. Because the extraction of energy that is caused by the single choke 54*a* decreases with downstream distance through the apparatus, the core flow 60 must impart on a second choke 54*b* to continue further reduction of the recoverable dynamic pressure through the apparatus 48. This process continues until the flow exits the apparatus at 62 and enters an open zone 64 at that location. Due to the presence of the plurality of circumferential chokes 54, the recovered pressure (and flow momentum) at the apparatus exit 62 has been substantially lowered compared to the exit of the known guide-can 14.

Figure 5:
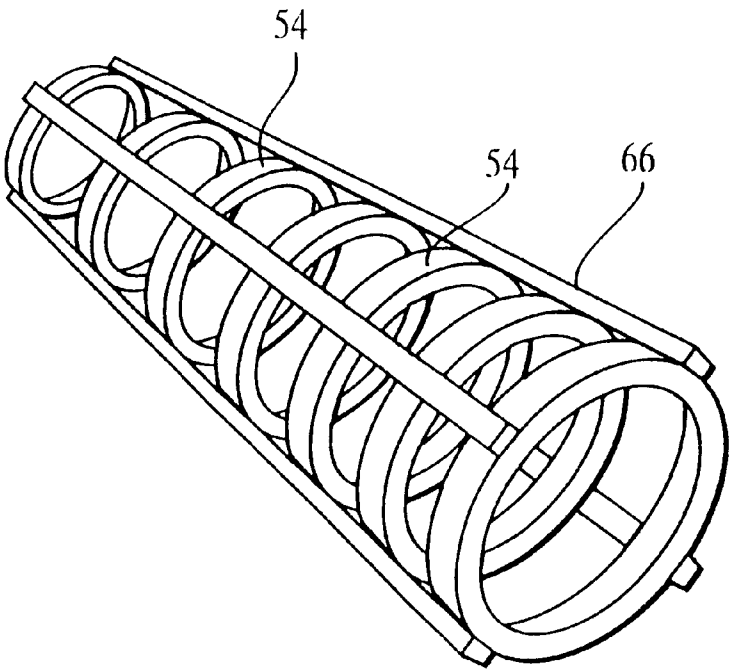
FIG. 5 is a detailed view of a choke ring assembly according to the present invention.

The chokes 54 may be integrally formed with the inner peripheral wall 56 of the apparatus housing, either as a one-piece construction or separately fixed thereto. FIG. 5 is a detailed view of a choke ring assembly according to the present invention. Specifically, the choke ring assembly is shown herein as being of a one piece construction having a series of spaced chokes 54 and a plurality of longitudinal ribs 66 spaced around the outer periphery of the chokes 54 for holding the chokes 54 together. It should also be understood that the number and placement of the chokes 54 may vary according to the application of the device and the density or viscosity of the fluid in which it is used. As such, if a one-piece apparatus is constructed, the spacing of the chokes 54 may be predetermined or calculated according to their end use. Likewise, if the chokes 54 are separately installed into the housing wall 56, then the installation and number of chokes may be similarly calculated according to their end use.

A pressure profile illustrating the loss of pressure through the apparatus compared to that observed in the known guide-can 14 is illustrated in FIG. 4. With a lower recovered pressure and a lower momentum of flow exiting the apparatus, the stagnation pressure on the torpedo nose 38 will consequently be lowered. Thus, the resultant adverse pressure across the torpedo 36 is reduced thereby minimizing the potential for harmful damage to the torpedo, including any attached devices. In addition, the reverse flow through the impeller is concurrently reduced, thereby minimizing the potential structural fatigue at start-up.

The advantages and new features of this invention include a series of equidistant circumferential chokes for generating high turbulent activity within the apparatus, the design of an apparatus for reducing recovered pressure and thereby reducing the stagnation pressure at the torpedo nose prior to launch. Further, the design is such that the reduction of recovered pressure is directly proportional to the number of chokes within the apparatus. The beneficial results include minimizing harmful damage to the torpedo, minimizing mechanical fatigue to the impeller at startup due to a reverse flow, and easy replacement of the guide-can with the apparatus.

It should also be understood that alternatives are available in connection with the present invention for potentially reducing the stagnation pressure at the torpedo nose. These include sealing the gaps between the shutter doors and the submarine hull, and preventing the flow from entering the SGR by enclosing the separated zone between the guide-can and the shutter door.

Finally, it is anticipated that the invention herein will have far reaching applications other than those of underwater vehicles.

This invention has been disclosed in terms of certain embodiments. It will be apparent that many modifications can be made to the disclosed apparatus without departing from the invention. Therefore, it is the intent of the appended claims to cover all such variations and modifications as come within the true spirit and scope of this invention.

What is claimed is:

1. A pressure control apparatus for a submarine launchway comprising:

a shutterway for enabling an entrance of fluid into the launchway, said shutterway having a first end and a second end;

a control portion for serially reducing fluid momentum of a main core flow from said shutterway, said control portion having a first end thereof adjacent the second end of said shutterway and a second end opposite the first end;

a launch tube aligned with said control portion and spaced from the second end of said control portion; and a free flood region surrounding said shutterway and said control portion, said free flood region exhausting fluid flow from said device.

2. The apparatus according to claim 1 wherein said control portion includes a cylindrical housing having an inner peripheral wall surface, and a plurality of spaced circumferential chokes mounted to the inner peripheral wall surface.

3. The apparatus according to claim 2 wherein said plurality of spaced chokes are evenly spaced within said control portion.

4. The apparatus according to claim 2 wherein each of said plurality of chokes includes a longitudinal opening formed therethrough for passage of the main core flow.

5. The apparatus according to claim 1 wherein a circumferential choke within the control portion generates a turbulent free shear layer downstream thereof.

6. The apparatus according to claim 2 wherein said plurality of circumferential chokes generate sequentially reduced turbulent free shear layers in a direction toward said launch tube.

7. The apparatus according to claim 2 wherein said plurality of circumferential chokes are connected by at least one longitudinal rib member.

8. The apparatus according to claim 7 wherein said at least one longitudinal rib member is integrally connected to said plurality of circumferential chokes.

9. The apparatus according to claim 8 wherein said at least one longitudinal rib member and said plurality of circumferential chokes are formed as a one-piece construction.

10. The apparatus according to claim 9 wherein a plurality of longitudinal rib members are formed as a one-piece construction with said plurality of circumferential chokes.

11. The apparatus according to claim 10 wherein said plurality of longitudinal rib members are spaced from each other around said plurality of circumferential chokes.

12. A fluid pressure control apparatus comprising:

an elongated housing having an opening at a first end thereof, an opening at a second end thereof, an inner peripheral surface and a fluid flow passageway therethrough; and a plurality of choke members fixed to the inner peripheral surface of said housing, each said plurality of choke members being spaced from an adjacent choke member and projecting into the fluid flow passageway of said longitudinal housing for interrupting at least a portion of the fluid flow therethrough;

said plurality of choke members sequentially produce a reduced turbulent free shear fluid layer within said elongated housing.

13. The apparatus according to claim 12 wherein said plurality of spaced chokes are evenly spaced within said housing.

14. The apparatus according to claim 12 wherein a single one of said plurality of circumferential chokes generates a turbulent free shear layer downstream thereof.

15. The apparatus according to claim 12 wherein said plurality of circumferential chokes are connected by at least one longitudinal rib member.

16. The apparatus according to claim 12 wherein said at least one longitudinal rib member is integrally connected to said plurality of circumferential chokes.

17. The apparatus according to claim 16 wherein said at least one longitudinal rib member and said plurality of circumferential chokes are formed as a one-piece construction.

18. The apparatus according to claim 17 wherein a plurality of longitudinal rib members are formed as a one-piece construction with said plurality of circumferential chokes.

19. The apparatus according to claim 18 wherein said plurality of longitudinal rib members are spaced from each other around said plurality of circumferential chokes.

20. A fluid pressure control apparatus comprising:

an elongated housing having an opening at a first end thereof, an opening at a second end thereof, an inner peripheral surface and a fluid flow passageway therethrough;

a plurality of choke members fixed to the inner peripheral surface of said housing, each said plurality of choke members being spaced from an adjacent choke member and projecting into the fluid flow passageway of said longitudinal housing for interrupting at least a portion of the fluid flow therethrough and serially reducing fluid momentum of a flow in the fluid flow passageway; and at least one longitudinal rib member connecting said plurality of choke members, said at least one longitudinal rib member and said plurality of choke members being formed of a one-piece construction.

21. The apparatus according to claim 20 wherein a plurality of longitudinal rib members are formed as a one-piece construction with said plurality of choke members.

22. The apparatus according to claim 21 wherein said plurality of longitudinal rib members are spaced around said plurality of choke members.

* * * * *